US006918972B2

(12) United States Patent
Ueta et al.

(10) Patent No.: US 6,918,972 B2
(45) Date of Patent: Jul. 19, 2005

(54) NI-BASE ALLOY, HEAT-RESISTANT SPRING MADE OF THE ALLOY, AND PROCESS FOR PRODUCING THE SPRING

(75) Inventors: Shigeki Ueta, Nagoya (JP); Toshiharu Noda, Nagoya (JP)

(73) Assignee: Daido Tokushuko Kabushiki Kaisha, Nagoya (JP)

( * ) Notice: Subject to any disclaimer, the term of this patent is extended or adjusted under 35 U.S.C. 154(b) by 129 days.

(21) Appl. No.: 10/371,363

(22) Filed: Feb. 20, 2003

(65) Prior Publication Data

US 2003/0164213 A1 Sep. 4, 2003

(30) Foreign Application Priority Data

Feb. 27, 2002 (JP) ..... 2002-051700

(51) Int. Cl.[7] ..... C22C 19/05

(52) U.S. Cl. ..... 148/428; 148/671; 420/446; 420/450

(58) Field of Search ..... 148/428, 671; 420/446, 450

(56) References Cited

U.S. PATENT DOCUMENTS 4,798,632 A 1/1989 Yonezawa et al.
4,979,995 A 12/1990 Hattori et al.
5,480,283 A * 1/1996 Doi et al. ..... 415/199.5

FOREIGN PATENT DOCUMENTS

| | | | |
|---|---|---|---|
| EP | 0 091 279 | A | 10/1983 |
| EP | 0 244 520 | A | 11/1987 |
| EP | 1 154 027 | A | 11/2001 |
| JP | 61-143567 | A | 7/1986 |
| JP | 63-96214 | A | 4/1988 |

* cited by examiner

*Primary Examiner*—John P. Sheehan
(74) *Attorney, Agent, or Firm*—Frishauf, Holtz, Goodman & Chick, P.C.

(57) ABSTRACT

A Ni-base alloy which has excellent resistance to permanent set at high temperature and which can be produced at low cost, a heat-resistant spring made of the Ni-base alloy, and a process for producing the spring. The Ni-base alloy of the present invention consists of 0.01 to 0.15 mass % of C, 2.0 mass % or less of Si, 2.5 mass % or less of Mn, 12 to 25 mass % of Cr, 5.0 mass % or less of Mo and/or 5.0 mass % or less of W on condition that Mo+W/2 does not exceed 5.0 mass % or less, 1.5 to 3.5 mass % of Ti, 0.7 to 2.5 mass % of Al, 20 mass % or less of Fe, and the balance of Ni and unavoidable impurities. The ratio of Ti/Al in terms of atomic percentage ranges from 0.6 to 1.5 and the total content of Ti and Al ranges from 4.0 to 8.5 atomic %.

15 Claims, No Drawings

NI-BASE ALLOY, HEAT-RESISTANT SPRING MADE OF THE ALLOY, AND PROCESS FOR PRODUCING THE SPRING

BACKGROUND OF THE INVENTION

1. Field of the Invention

The present invention relates to a Ni-base alloy, a heat-resistant spring made of the alloy and a process for producing the spring, and more particularly to a Ni-base alloy which has high resistance to permanent set at high temperature, can be produced at low cost, and thus is suited especially as a material for heat-resistant springs.

2. Description of the Related Art

Heat-resistant springs are used in an exhaust gas system for an automobile engine, an airplane engine and the like. Such heat-resistant springs need to be made of a material having high-temperature strength and high resistance to permanent set.

As the material of such heat-resistant springs, heat-resistant alloys such as A286™, Inconel® X750, Inconel® 718 and Refractaloy™ are exemplified in "Data Collection for high-temperature strength of heat-resistant spring and materials therefor" (1986) published by Spring Technology Association, and "Data of high-temperature strength for heat-resistant spring and materials therefor (continued)" (1989) published by Spring Technology Association.

In these days, heat-resistant springs are required to have even higher resistance to permanent set at elevated temperatures than convention springs and at the same time be produced at low cost.

SUMMARY OF THE INVENTION

An object of the present invention is to provide Ni-base alloy suited for producing a heat-resistant spring that meets the aforementioned requirements.

Another object of the present invention is to provide a heat-resistant spring produced using the alloy.

A further object of the present invention is to provide a process for producing the heat-resistant spring by using the alloy.

To accomplish the aforementioned objects, according to the present invention there is provided a Ni-base alloy consisting of: 0.01 to 0.15 mass % of C; 2.0 mass % or less of Si; 2.5 mass % or less of Mn; 12 to 25 mass % of Cr; 5.0 mass % or less of Mo and/or 5.0 mass % or less of W on condition that Mo+W/2 be 5.0 mass % or less; 1.5 to 3.5 mass % of Ti; 0.7 to 2.5 mass % of Al; 20 mass % or less of Fe; and the balance of Ni and unavoidable impurities, wherein a ratio of Ti/Al in terms of atomic percentage ranges from 0.6 to 1.5, and a total content of Ti and Al ranges from 4.0 to 8.5 atomic %.

Also, according to the present invention, there is provided a heat-resistant spring produced using the above alloy, which not only has a stress retention of as high as 40 % or more after a relaxation test conducted at 700° C. for 50 hours, thus exhibiting remarkably high resistance to permanent set, but also can be produced at low cost.

Further, according to the present invention there is provided a process for producing a heat-resistant spring which comprises the steps of: performing solution treatment to a rod or plate made of the Ni-base alloy; subjecting the rod or plate to cold working with a reduction ratio of 20% or more to form the rod or plate into a predetermined shape; and aging the rod or plate at a temperature of 600 to 900° C. for 0.5 to 24 hours.

DETAILED DESCRIPTION OF THE PREFERRED EMBODIMENTS

Generally, the design concept for producing a heat-resistant spring from Ni-base alloy resides in that a rod or plate made of the Ni-base alloy is cold worked into the form of a spring (coil spring, leaf spring, etc.) and then subjected to aging so as to derive a precipitation strengthening effect by γ' phase (i.e. $Ni_3(Al,Ti)$) and thereby enhance the resistance to permanent set.

Taking the heat-resistant spring production process into consideration, the inventors hereof investigated the relationship between individual components of the alloy and the resistance to permanent set. Consequently, the inventors have found out that resistance to permanent set is affected not only by the precipitation strengthening by means of the γ' phase but also by the solid solution strengthening and/or grain boundary strengthening by means of the various components. The present invention is based on these findings.

The Ni-base alloy according to the present invention has the composition described above. Among the components, C serves to enhance the high-temperature strength of the alloy by combining with Cr and Ti to produce carbide in the matrix. The content of C ranges from 0.01 to 0.15 mass %. If the C content is less than 0.01 mass %, the aforementioned effect cannot be obtained. On the other hand, if the C content exceeds 0.15 mass %, the carbide is produced excessively, lowering toughness and elongation as well as the hot workability and cold workability. Also, in the case where Nb and Ta are contained, C accomplishes the same effect of enhancing the high-temperature strength of the alloy through the same mechanism.

Si is a component that mainly acts as a deoxidizing agent during the preparation of the alloy. If Si is contained too much, the toughness and workability of the alloy deteriorate. Thus, it is necessary to limit the Si content to 2.0 mass % or less.

Like Si, Mn serves as a deoxidizing agent. If the Mn is too much, the alloy lowers in workability, and also becomes more liable to undergo high-temperature oxidation. The Mn content is therefore limited to 2.5 mass % or less.

Cr is a component for preventing the alloy from oxidizing and corroding at high temperature, and the content thereof is set to range from 12 to 25 mass %. If the Cr content is lower than 12 mass %, the intended effects cannot be attained. On the other hand, if the Cr content exceeds 25 mass %, a (sigma) phase precipitates in the alloy, so that the toughness and high-temperature strength deteriorate.

Both of Mo and W serve to enhance strength of the alloy at high temperature by means of solid solution strengthening. Mo and W may be contained solely or in combination. In both cases, it is required that the respective contents be 5.0 mass % or less and further that the content of Mo+W/2 be 5.0 mass % or less. This is because 5.0 mass % is extended, the workability of the alloy lowers and also the cost thereof increase.

Ti serves to enhance the high-temperature strength of the alloy by combining with Ni, together with Al, and thus producing γ' phase ($Ni_3(Al,Ti)$). The Ti content is set within a range of 1.5 to 3.5 mass %. If the Ti content is less than 1.5 mass %, the alloy does not exhibit sufficiently high strength at elevated temperature, because the temperature at which the produced γ' phase becomes solid solution is low. On the other hand, if the Ti content exceeds 3.5 mass %, the workability of the alloy lowers, and the high-temperature strength and toughness deteriorate since η phase ($Ni_3Ti$) is liable to precipitate.

Al is a component for enhancing the high-temperature strength of the alloy by combining with Ni and thus producing γ' phase. The Al content is set within a range of 0.7 to 2.5 mass %. If the Al content is less than 0.7 mass %, the γ' phase precipitation does not take place sufficiently, making it difficult to obtain the sufficient high-temperature strength. On the other hand, if the Al content exceeds 2.5 mass %, the workability of the alloy lowers.

Fe is contained to reduce the production cost of the alloy. It is, however, necessary to restrict the Fe content to 20 mass % or less, because if 20 mass % is exceeded, the high-temperature strength of the alloy lowers. The Fe content should preferably be 10 mass % or less.

In the Ni-base alloy of the present invention, Ti and Al satisfy the following relationships:

Namely, the ratio Ti/Al in terms of atomic percentage should range from 0.6 to 1.5, and the total content of Ti and Al should be within a range from 4.0 to 8.5 atomic %. If the Ti/Al ratio is smaller than 0.6, the aging effect of the γ' phase is insufficient to attain the satisfactory strength. On the other hand, if the Ti/Al ratio exceeds 1.5, the γ' phase becomes unstable, causing η phase to precipitate and consequent lowering in strength. Furthermore, if the content of Ti and Al is lower than 4.0 atomic %, the γ' phase precipitation is too little to attain the sufficient strength. On the other hand, if the total content of Ti and Al is higher than 8.5 atomic %, deterioration in hot workability is caused.

While the Ni-base alloy of the present invention contains the above-mentioned elements as its essential components, the alloy may further contain the following components:

Such components include B. B contributes to improving the hot workability. B also restrains the η phase from being produced, thereby preventing the high-temperature strength and toughness from lowering. Further, B serves to enhance the creep strength at high temperature. If the B content is too low, these effects are not obtained. On the other hand, if the B content is too high, the melting point of the alloy lowers and the hot workability deteriorates. Therefore, the B content preferably ranges from 0.001 to 0.02 mass %.

The Ni-base alloy may contain Zr. Like B, Zr serves to enhance the high-temperature creep strength. If the Zr content is too low, the intended effect is not be obtained. On the other hand, if the Zr content is too high, the toughness of the alloy lowers. Therefore, the Zr content preferably ranges from 0.01 to 0.10 mass %.

The alloy may further contain Co. Co is effective in enhancing the high-temperature creep strength of the alloy. However, if Co is contained too much, not only increases the production cost of the alloy, but the γ' phase becomes unstable. Accordingly, the Co content is preferably limited to 11 mass % or less.

The Ni-base alloy may also contain Nb and Ta. Both Nb and Ta are effective in further enhancing the high-temperature strength of the alloy by combining with Ni to produce γ' phase ($Ni_3$(Ti, Al, Nb, Ta)). However, if Nb and Ta are contained too much, the toughness of the alloy lowers. Therefore, the total content of Nb and Ta should preferably range from 0.1 to 3.0 mass %.

Furthermore, Mg and Ca may be contained. Mg and Ca both serve to enhance the cleanliness of the alloy through deoxidation and desulfurization during the preparation of the alloy. Mg and Ca are also effective in enhancing the grain boundary strength due to their segregation at the grain boundaries of the alloy structure. However, if Mg and Ca are contained too much, the hot workability of the alloy lowers. Hence, the total content of Mg and Ca preferably ranges from 0.001 to 0.01 mass %.

The alloy of the present invention may also contain Cu, P, S, O and N. However, if these components are contained too much, the hot workability deteriorates. Further, O and N deteriorate the mechanical characteristics of the alloy because they produce non-metallic inclusions. Accordingly, the contents of these components should preferably be limited as follows:

Cu : 0.5 mass % or less;

P : 0.2 mass % or less;

S : 0.01 mass % or less;

O : 0.01 mass % or less; and

N : 0.01 mass % or less.

Moreover, the alloy of the present invention may contain rare earth elements, since Y and Ce, for example, serve to enhance the oxidation resistance. However, even if the rare earth elements are contained too much, not only is the advantageous effect saturated, but the production cost of the alloy increases. Accordingly, the content of these rare earth elements is preferably limited to 0.10 mass % or less in total.

A process for producing a heat-resistant spring by using the aforementioned Ni-base alloy will be described.

The heat-resistant spring of the present invention produced by the below-mentioned process has such excellent resistance to permanent set that the stress retention thereof is as high as 40% or more after a relaxation test conducted at 700° C. for 50 hours.

First, solution treatment is performed on a rod or plate obtained by forging or rolling the alloy having the aforementioned composition, in order to prepare the solid solution of γ' phase and thus to make the metal structure homogenous. The conditions of the solution treatment are not particularly limited, and the treatment may be carried out at a temperature of 1000 to 1150° C. for a processing time of 0.1 to 4 hours.

Then, the rod or plate is subjected to cold working so as to form a spring with a desired shape. The cold working may be any one of wire drawing, cold rolling, swaging and the like. In this cold working step, the reduction ratio is set to 20% or more.

If the reduction ratio is lower than 20%, it is difficult to impart required characteristics such as sufficient high-temperature strength, high relaxation resistance and the like to the resulting spring. The preferable reduction ratio is 30% or more.

Subsequently, the cold-worked spring is subjected to aging to induce the γ' phase precipitation, solid solution strengthening and grain boundary strengthening that contribute to enhancement of the high-temperature strength, whereby the spring can be imparted excellent resistance to permanent set at high temperature.

When the aging is carried out at a temperature of 600 to 900° C. for 0.5 to 24 hours. If the aging conditions are not satisfied, the resulting spring douse not show a stress retention of 40% or more, so that the spring fails to attain the desired resistance to permanent set.

EXAMPLES (1) Comparison of Alloy Composition-Dependent Aging Hardness, High-Temperature Strength and Resistance to Permanent set Depending on alloy Compositions Alloys of various compositions shown in Table 1 below were melted in a high-frequency vacuum induction furnace an were cast into ingots of 50 kg, and each ingot was subjected to homogenizing heat treatment at 1180° C. for 16 hours.

Then, each ingot was subjected to hot forging and hot rolling to form a rod with a diameter of 24 mm. Each rod was further subjected to solution treatment at 1100° C. for two hours and then cooled in water.

Subsequently, each rod was cold worked with a reduction ratio of 40% or more with a diameter of 18.5 mm, and then was subjected to aging at 750° C. for 5 hours.

TABLE 1

Compositions of Alloys

| | Composition (mass %) | | | | | | | | | | | | | | | Ti—Al Relation (atomic %) | |
|---|---|---|---|---|---|---|---|---|---|---|---|---|---|---|---|---|---|
| | C | Si | Mn | Cr | Ni | Mo | W | Co | Ti | Al | Nb + Ta | Fe | B | Zr | Mg + Ca | Ti/Al | Ti and Al |
| Ex. 1 | 0.05 | 0.12 | 0.06 | 19.1 | Bal | 3.20 | — | — | 2.72 | 1.45 | — | 0.83 | | — | — | 1.06 | 6.25 |
| Ex. 2 | 0.03 | 0.22 | 0.08 | 16.9 | Bal | 1.63 | 0.82 | — | 2.46 | 1.63 | — | 2.60 | | — | — | 0.85 | 6.32 |
| Ex. 3 | 0.05 | 0.20 | 0.14 | 17.4 | Bal | 1.45 | 1.25 | — | 2.75 | 2.07 | — | 11.25 | | — | — | 0.75 | 7.52 |
| Ex. 4 | 0.06 | 0.08 | 0.04 | 18.8 | Bal | 1.51 | 1.60 | — | 2.81 | 1.22 | 1.09 | 2.67 | 0.0031 | 0.050 | 0.002 | 1.30 | 6.60 |
| Ex. 5 | 0.03 | 0.53 | 0.61 | 14.6 | Bal | — | 3.13 | 6.3 | 1.86 | 1.55 | 1.53 | 5.80 | 0.0050 | 0.071 | — | 0.68 | 6.34 |
| Ex. 6 | 0.10 | 0.06 | 0.03 | 21.5 | Bal | 1.44 | 2.11 | — | 2.83 | 1.28 | 0.48 | 3.14 | 0.0043 | 0.082 | — | 1.25 | 6.34 |
| Ex. 7 | 0.03 | 0.34 | 0.25 | 16.9 | Bal | 4.13 | — | — | 3.21 | 1.49 | — | 1.35 | 0.0026 | 0.047 | 0.003 | 1.21 | 6.98 |
| Ex. 8 | 0.05 | 0.19 | 0.20 | 20.8 | Bal | 0.99 | 2.43 | — | 2.19 | 0.88 | 2.02 | 4.11 | 0.0045 | 0.033 | — | 1.40 | 5.76 |
| Ex. 9 | 0.07 | 1.24 | 1.47 | 22.7 | Bal | 0.52 | 1.74 | 4.5 | 2.30 | 1.52 | 0.96 | 2.72 | 0.0061 | 0.074 | — | 0.85 | 6.39 |
| Ex. 10 | 0.04 | 0.23 | 0.18 | 18.5 | Bal | 1.05 | 1.29 | — | 2.27 | 1.70 | 1.31 | 4.09 | 0.0030 | 0.066 | — | 0.75 | 7.05 |
| Ex. 11 | 0.05 | 0.08 | 0.10 | 19.0 | Bal | 3.02 | 0.98 | — | 3.06 | 2.13 | — | 1.50 | 0.0052 | 0.013 | — | 0.81 | 8.05 |
| Comp. Ex. 1*1 | 0.06 | 0.43 | 0.62 | 14.3 | 24.9 | 1.04 | — | — | 2.10 | 0.18 | V:0.25 | Bal | 0.0020 | — | — | 6.57 | 2.82 |
| Comp. Ex. 2*2 | 0.05 | 0.28 | 0.23 | 15.3 | Bal | — | — | — | 2.54 | 0.77 | 0.92 | 6.65 | — | — | — | 1.89 | 5.17 |
| Comp. Ex. 3*3 | 0.08 | 0.52 | 0.36 | 19.1 | 37.5 | 3.12 | — | 19.2 | 2.67 | 0.23 | — | Bal | 0.0015 | — | — | 6.54 | 3.63 |
| Comp. Ex. 4*4 | 0.04 | 0.13 | 0.16 | 18.0 | 53.3 | 3.08 | — | — | 1.04 | 0.46 | 5.15 | Bal | 0.0029 | — | — | 1.27 | 5.46 |
| Comp. Ex. 5 | 0.04 | 0.21 | 0.18 | 16.4 | Bal | 2.13 | — | — | 3.35 | 0.78 | 0.60 | 3.1 | 0.0030 | 0.045 | — | 2.42 | 5.99 |
| Comp. Ex. 6 | 0.03 | 0.19 | 0.18 | 17.5 | Bal | 1.50 | 1.06 | — | 1.71 | 1.72 | 1.83 | 2.6 | 0.0026 | 0.039 | — | 0.56 | 6.73 |

*1alloy corresponding to A286
*2alloy corresponding to Inconel X750
*3alloy corresponding to Refractaloy 26
*4alloy corresponding to Inconel 718®

The obtained rods were measured as to hardness after aging (HRC; Rockwell hardness), 0.2% proof strength (MPa) at 700° C. and tensile strength (MPa). Also, a 50-hour relaxation test at 700° C. was conducted with an initial stress set to 500 MPa, and the stress retention (%) after the test was calculated. The greater the stress retention, the higher resistance to permanent set the alloy has. The measurement results are shown in Table 2 below.

The above relaxation test was carried out pursuant to the method prescribed in JIS Z2276.

TABLE 2

Comparison of alloy composition-dependent aging hardness, high-temperature strength and resistance to permanent set

| | Aging Hardness ($H_{RC}$) | High-temperature strength: 0.2% Proof Stress (MPa, 700° C.) | High-temperature strength: Tensile Strength (MPa, 700° C.) | Resistance to Permanent Set. Stress Retention (%) |
|---|---|---|---|---|
| Ex. 1 | 45.0 | 1085 | 1346 | 50 |
| Ex. 2 | 46.8 | 1105 | 1388 | 52 |
| Ex. 3 | 47.8 | 1128 | 1399 | 57 |
| Ex. 4 | 47.3 | 1273 | 1404 | 56 |
| Ex. 5 | 46.2 | 1119 | 1367 | 51 |
| Ex. 6 | 49.4 | 1364 | 1498 | 59 |
| Ex. 7 | 51.8 | 1481 | 1543 | 62 |
| Ex. 8 | 44.6 | 1080 | 1345 | 49 |
| Ex. 9 | 46.9 | 1180 | 1382 | 52 |
| Ex. 10 | 47.5 | 1297 | 1461 | 57 |
| Ex. 11 | 53.7 | 1533 | 1567 | 64 |
| Comp. Ex. 1 | 39.8 | 816 | 934 | 14 |
| Comp. Ex. 2 | 44.2 | 885 | 1119 | 25 |

TABLE 2-continued

Comparison of alloy composition-dependent aging hardness, high-temperature strength and resistance to permanent set

| | Aging Hardness ($H_{RC}$) | High-temperature strength: 0.2% Proof Stress (MPa, 700° C.) | High-temperature strength: Tensile Strength (MPa, 700° C.) | Resistance to Permanent Set. Stress Retention (%) |
|---|---|---|---|---|
| Comp. Ex. 3 | 42.7 | 863 | 1098 | 19 |
| Comp. Ex. 4 | 47.1 | 1149 | 1324 | 28 |
| Comp. Ex. 5 | 45.7 | 1099 | 1330 | 35 |
| Comp. Ex. 6 | 42.3 | 852 | 1035 | 22 |

As is apparent from Table 2, the alloys of Examples 1 to 11 have remarkably high resistance to permanent set, compared with Inconel 718® (Comparative Example 4), and also have high-temperature strength equivalent to that of Inconel 718®, whereby proving to be very suitable a materials for heat-resistant springs.

(2) Comparison of Resistance to Permanent Set Depending on Reduction Ratios

Using the alloy of the composition of Example 6, sample rods were obtained under the same conditions as in Example 6, except that the reduction ratios at the cold working were changed. Then, the resistance to permanent set (stress retention) of the sample rod were measured. The results are shown in Table 3 below.

TABLE 3

| Comparison of resistance to permanent set depending on reduction ratios | | |
|---|---|---|
| Reduction Ratio (%) | Stress Retention (%) | Remarks |
| 5 | 26 | |
| 10 | 30 | |
| 20 | 41 | |
| 30 | 52 | |
| 40 | 59 | Example 6 |
| 50 | 62 | |

As is apparent from Table 3, in order to obtain a stress retention of 40% or more, the reduction ratio at the cold working should be set to 20% or more.

(3) Comparison of Resistance to Permanent Set Depending on Aging Conditions

Using the alloy with the same composition as Example 1, sample rods were obtained under the same conditions as in Example 1, except that the aging conditions were changed as shown in Table 4 below. Then, the sample rods were measured as to the resistance to permanent set. The results are shown in Table 4.

TABLE 4

| Comparison of resistance to permanent set depending on aging conditions | | | |
|---|---|---|---|
| | Aging Conditions | | Stress |
| | Temperature (° C.) | Time (hr) | Retention (%) |
| Aging 1 | 750 | 0.1 | 34 |
| Aging 2 | 750 | 2 | 48 |
| Aging 3 | 750 | 32 | 36 |
| Aging 4 | 550 | 5 | 33 |
| Aging 5 | 950 | 5 | 28 |

As is apparent from Table 4, in the case of aging 4 where the aging temperature was low (550° C.) and aging 5 where the aging temperature was high (950° C.), the sample rods had stress retentions less than 40%, failing to show excellent resistance to permanent set.

Further, also in cases where the aging temperature was within the range from 600 to 900° C. but the aging time was short (0.1 hr) as in aging 1 or was long (32 hrs) as in aging 3, the sample rods had stress retentions less than 40%, failing to show high resistance to permanent set.

From these results, it is confirmed that to ensure high resistance to permanent set of 40% or more in terms of stress retention, the aging treatment needs to be performed at a temperature of 600 to 900° C. for 0.5 to 24 hours.

As is apparent from the above description, the heat-resistant spring produced using the Ni-base alloy of the present invention under the conditions specified in the present invention has remarkably high resistance to permanent set at high temperature, as compared with Inconel 718®, for instance.

Moreover, the heat-resistant spring of the present invention can be produced at low cost since it may not contain expensive Co as its essential component.

What is claimed is:

1. A Ni-base alloy comprising:

0.01 to 0.15 mass % of C;

not greater than 2.0 mass %, but greater than 0 mass % of Si;

not greater than 2.5 mass %, but greater than 0 mass % of Mn;

12 to 25 mass % of Cr;

5.0 mass % or less of Mo and 5.0 mass % or less of W on condition that Mo+(W/2) be not greater than 5.0 mass %, but greater than 0 mass %;

1.5 to 3.5 mass % of Ti;

0.7 to 2.5 mass % of Al;

not greater than 20 mass %, but greater than 0 mass % of Fe; and a balance of Ni and unavoidable impurities, wherein a ratio of Ti/Al in terms of atomic percentages ranges from 0.6 to 1.5 and a total content of Ti and Al ranges from 4.0 to 8.5 atomic %.

2. The Ni-base alloy according to claim 1, wherein said Ni-base alloy further comprises 0.001 to 0.02 mass % of B and/or 0.01 to 0.10 mass % of Zr.

3. The Ni-base alloy according to claim 1 or 2, wherein said Ni-base alloy further comprises not greater than 11 mass %, but greater than 0 mass % of Co.

4. The Ni-base alloy according to claim 3, wherein said Ni-base alloy further comprises 0.1 to 3.0 mass % of Nb and Ta.

5. The Ni-base alloy according to claim 3, wherein said Ni-base alloy further comprises 0.001 to 0.1 mass % of Mg and Ca.

6. A heat-resistant spring made of a Ni-base alloy comprising 0.01 to 0.15 mass % of C; not greater than 2.0 mass %, but greater than 0 mass % of Si; not greater than 2.5 mass %, but greater than 0 mass % of Mn; 12 to 25 mass % Cr; 5.0 mass % or less of Mo and 5.0 mass % or less of W on condition that Mo+(W/2) be not greater than 5.0 mass %, but greater than 0 mass %; 1.5 to 3.5 mass % of Ti; 0.7 to 2.5 mass % of Al; greater than 20 mass %, but greater than 0 mass % of Fe, and a balance of Ni and unavoidable impurities, a ratio of Ti/Al in terms of atomic percentage ranging from 0.6 to 1.5, and a total content of Ti and Al ranging from 4.0 to 8.5 atomic %, wherein the spring has a stress retention of 40% or more after a relaxation test conducted at 700° C. for 50 hours.

7. The heat-resistant spring according to claim 6, wherein said Ni-base alloy further comprises 0.001 to 0.02 mass % of B and/or 0.01 to 0.10 mass % of Zr.

8. The heat-resistant spring according to claim 6 or 7, wherein said Ni-base alloy further comprises not greater than 11 mass %, but greater than 0 mass % of Co.

9. The heat-resistant spring according to claim 8, wherein said Ni-base alloy further comprises 0.1 to 3.0 mass % of Nb and Ta.

10. The heat-resistant spring according to claim 8, wherein said Ni-base alloy further comprises 0.001 to 0.01 mass % of Mg and Ca.

11. A process for producing a heat-resistant spring comprising the steps of:

performing a solution treatment to a rod or plate made of a Ni-base alloy, the Ni-base alloy comprising 0.01 to 0.15 mass % of C; not greater than 2.0 mass %, but greater than 0 mass % of Si; not greater than 2.5 mass %, but greater than 0 mass % of Mn; 12 to 25 mass % of Cr; 5.0 mass % or Less of Mo and 5.0 mass % or less of W on condition that Mo+(W/2) be not greater than 5.0 mass %, but greater than 0 mass % 1.5 to 3.5 mass % of Ti; 0.7 to 2.5 mass % of Al; not greater than 20 mass %, but greater than 0 mass % of Fe; and a balance of Ni and unavoidable impurities, a ratio of Ti/Al in terms of atomic percentage ranging from 0.6 to 1.5, and a total content of Ti and Al ranging from 4.0 to 8.5 atomic %;

subjecting the rod or plate, on which the solution treatment has been performed, to cold working with a reduction ratio of 20% or more to form the rod or plate into a predetermined shape; and aging the rod or plate member at a temperature of 600° C. to 900° C. for 0.5 to 24 hours.

12. The process according to claim 11, wherein said Ni-base alloy further comprises 0.001 to 0.02 mass % of B and/or 0.01 to 0.10 mass % of Zr.

13. The process according to claim 11 or 12, wherein said Ni-base alloy further comprises 11 mass % or less of Co.

14. The process according to claim 13, wherein said Ni-base alloy further comprises 0.1 to 3.0 mass % of Nb and Ta.

15. The process according to claim 13, wherein said Ni-base alloy further comprises 0.001 to 0.01 mass % of Mg and Ca.

* * * * *